US007343677B2

(12) United States Patent
Twigg

(10) Patent No.: US 7,343,677 B2
(45) Date of Patent: Mar. 18, 2008

(54) METHOD OF MANUFACTURING A FIBER REINFORCED METAL MATRIX COMPOSITE ARTICLE

(75) Inventor: Edwin S Twigg, Derby (GB)

(73) Assignee: Rolls-Royce plc, London (GB)

( * ) Notice: Subject to any disclaimer, the term of this patent is extended or adjusted under 35 U.S.C. 154(b) by 45 days.

(21) Appl. No.: 10/969,058

(22) Filed: Oct. 21, 2004

(65) Prior Publication Data

US 2005/0086789 A1 Apr. 28, 2005

(30) Foreign Application Priority Data

Oct. 24, 2003 (GB) ..... 0324810.1

(51) Int. Cl.

| | |
|---|---|
| ***B21K 25/00*** | (2006.01) |
| ***B21K 3/04*** | (2006.01) |
| ***B23P 15/04*** | (2006.01) |
| ***B23P 15/02*** | (2006.01) |
| ***B21D 53/78*** | (2006.01) |

(52) U.S. Cl. ..... 29/889.71; 29/889.2

(58) Field of Classification Search ..... 29/458, 29/889.7, 889.71, 889.2, 530; 419/49
See application file for complete search history.

(56) References Cited

U.S. PATENT DOCUMENTS

| | | | | |
|---|---|---|---|---|
| 4,732,314 A | | 3/1988 | Sakamoto | |
| 4,809,903 A | | 3/1989 | Eylon | |
| 5,260,137 A | | 11/1993 | Rosenthal | |
| 5,261,940 A | | 11/1993 | Berczik | |
| 5,305,520 A | * | 4/1994 | Doorbar et al. | 29/889.21 |
| 5,425,494 A | * | 6/1995 | Rosenthal et al. | 228/124.5 |
| 5,427,304 A | * | 6/1995 | Woods et al. | 228/190 |
| 5,470,524 A | * | 11/1995 | Krueger et al. | 419/5 |
| 5,501,906 A | * | 3/1996 | Deve | 428/366 |
| 5,675,837 A | * | 10/1997 | Robertson | 419/24 |
| 5,881,355 A | * | 3/1999 | Sugimura et al. | 419/20 |
| 5,896,658 A | * | 4/1999 | Calle et al. | 29/889.72 |
| 5,946,801 A | * | 9/1999 | Twigg et al. | 29/889.71 |
| 6,214,134 B1 | * | 4/2001 | Eylon et al. | 148/516 |

(Continued)

FOREIGN PATENT DOCUMENTS

| | | |
|---|---|---|
| EP | 0 468 221 | 1/1992 |

(Continued)

OTHER PUBLICATIONS

R. Suplinskas et al., Boron Carbide Coated Boron for Metal Matrix, SAMPE (V 11), 1979.

(Continued)

*Primary Examiner*—David P. Bryant
*Assistant Examiner*—Christopher M Koehler
(74) *Attorney, Agent, or Firm*—W. Warren Taltavull; Manelli Denison & Selter PLLC

(57) ABSTRACT

A method of manufacturing a fibre reinforced metal matrix composite article, the method comprising placing at least one metal coated (18) fibre (14) between a first metal ring (30) and a second metal ring (36). Heating to a first temperature and applying a first pressure to partially consolidate the metal (18) on the at least one metal coated (18) fibre (14) and heating to a second temperature and applying a second pressure to consolidate the metal of the first and second metal rings (30, 36), wherein the first temperature is different to the second temperature and the first pressure is different to the second pressure.

15 Claims, 4 Drawing Sheets

U.S. PATENT DOCUMENTS

| | | | | |
|---|---|---|---|---|
| 6,247,638 | B1 * | 6/2001 | Ress, Jr. | 228/193 |
| 6,658,715 | B1 * | 12/2003 | Podesta' | 29/419.1 |
| 6,698,645 | B1 * | 3/2004 | Buchberger et al. | 228/173.1 |
| 6,858,177 | B2 * | 2/2005 | Kono et al. | 419/5 |
| 2003/0029904 | A1 | 2/2003 | Pursell | |

FOREIGN PATENT DOCUMENTS

| | | |
|---|---|---|
| EP | 0 587 438 | 3/1994 |
| EP | 0 831 154 | 3/1998 |
| EP | 0831154 A | 3/1998 |
| EP | 1 288 324 | 3/2003 |
| EP | 1288324 A | 3/2003 |
| EP | 1306459 A | 5/2003 |
| WO | WO 00/47792 A | 8/2000 |

OTHER PUBLICATIONS

A. Hirose et al., Joining Processes for Structural Applications of Continuous Fiber Reinforced MMCs, Trans Tech Publications, 1995.

Dunford, Diffusion Bonding of Advanced Aerospace Metallics, Materials Research Society, 1993.

* cited by examiner

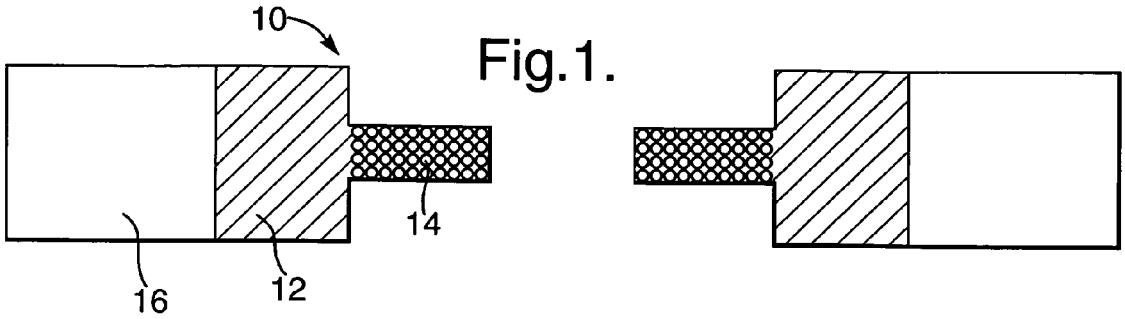
Fig.1.
Fig.2.
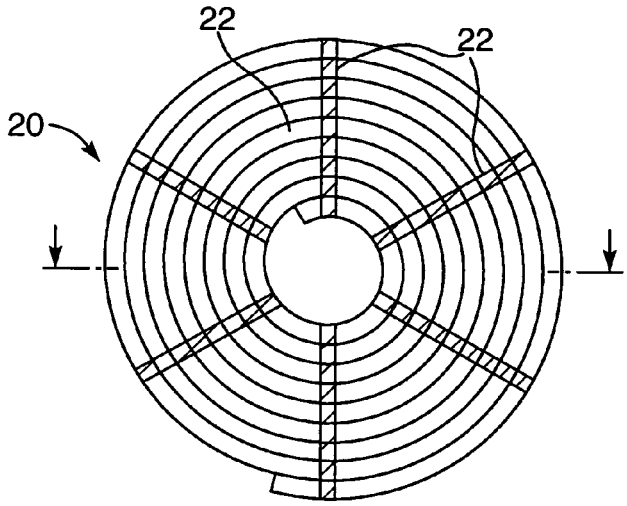
Fig.3.
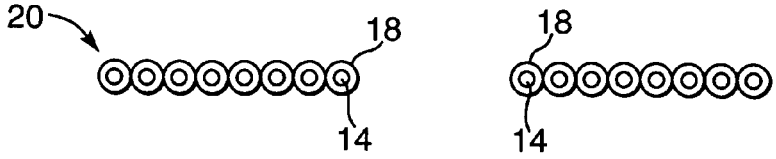

METHOD OF MANUFACTURING A FIBER REINFORCED METAL MATRIX COMPOSITE ARTICLE

FIELD OF THE INVENTION

The present invention relates to a method of manufacturing a fiber reinforced metal matrix composite article, and the present invention relates in particular to a method of manufacturing a fiber reinforced metal matrix composite rotor.

BACKGROUND OF THE INVENTION

In one known method of manufacturing a fiber reinforced metal matrix composite article, as disclosed in European patent No. EP0831154B1, a plurality of metal coated fibers are placed in an annular groove in a metal ring and a metal ring is placed on top of the metal coated fibers. Each of the metal coated fibers is wound spirally in a plane and the metal coated fiber spirals are stacked in the annular groove in the metal ring. The metal ring is pressed predominantly axially to consolidate the assembly and to diffusion bond the metal rings and the metal coated fiber spirals together to form an integral structure.

In a further known method of manufacturing a fiber reinforced metal matrix composite article, as disclosed in European patent application No. EP1288324A2, the arrangement described in EP0831154B1 is modified by the inclusion of metal wires in the annular groove in the metal ring with the metal coated fibers. Each of the metal wires is wound spirally in a plane and the metal wire spirals are stacked in the annular groove in the metal ring with the metal coated fibers spirals.

Conventionally hot isostatic pressing (HIP) is used as a single stage process to consolidate, to increase the density of, a porous article where the initial density of the porous article is relatively high and therefore the change of shape of the article is usually very small.

Hot isostatic pressing (HIP) is suitable for the consolidation of fiber reinforced metal matrix composite articles, however, the initial density may be as low as 50% and therefore the change in volume and shape will be substantial. In general the consolidation of fiber reinforced metal matrix composite articles has been by hot isostatic pressing, but control of the final shape of the fiber reinforced area of the fiber reinforced metal matrix composite article is difficult, or the control of the position of the fibers in the fiber reinforced metal matrix composite article is difficult.

Accordingly the present invention seeks to provide a novel method of manufacturing a fiber reinforced metal matrix composite article.

SUMMARY OF THE INVENTION

Accordingly the present invention provides a method of manufacturing a fiber reinforced metal matrix composite article, the method comprising the steps of:

(a) placing at least one fiber and filler metal between a first metal component and a second metal component, (b) heating to a first temperature and applying a first pressure to partially consolidate the at least one fiber and filler metal and (c) heating to a second temperature and applying a second pressure to consolidate the metal of the first and second metal components, wherein the first temperature is different to the second temperature and the first pressure is different to the second pressure.

Preferably the first temperature is less than the second temperature, the first pressure is less than the second pressure and step (c) includes diffusion bonding of the filler metal and the first and second metal components.

Preferably step (a) comprises placing at least one metal coated fiber, at least one fiber and at least one metal wire or at least one fiber and at least one metal foil between the first metal component and the second metal component, step (b) comprises heating to a first temperature and applying a first pressure to partially consolidate the metal on the at least one metal coated fiber, the at least one metal wire or the at least one metal foil.

Preferably the first and second metal components comprise a titanium alloy and the at least one fiber is coated in a titanium alloy or the at least one metal wire is a titanium alloy wire, the first temperature is about 700 C., the second temperature is about 925 C., the first pressure is about 50 Mpa and the second pressure is about 100 Mpa Preferably the fibers are silicon carbide fibers, silicon nitride fibers, boron fibers or alumina fibers.

Preferably the at least one metal coated fiber is a titanium coated fiber, a titanium aluminide coated fiber or a titanium alloy coated fiber.

Preferably the at least one metal wire is a titanium wire, a titanium aluminide wire or a titanium alloy wire.

Preferably the first metal component and the second metal component comprise titanium, titanium aluminide or titanium alloy.

Preferably step (a) comprises forming a groove in the first metal component, placing the at least one fiber and the filler metal in the groove of the first metal component and placing the second metal component in the groove of the first metal component.

Preferably step (a) comprises forming a projection on the second metal component and placing the projection of the second metal component in the groove of the first metal component.

Preferably step (a) comprises forming a circumferentially extending groove in an axial face of the first metal member, placing the at least one circumferentially extending fiber and the filler metal in the circumferentially extending groove of the first metal component and placing the second metal component in the groove of the first metal component.

Preferably step (a) comprises placing a plurality of fibers between the first and second metal components.

Preferably step (a) comprises placing a plurality of fibres between the first and second metal components.

Preferably the second temperature and the second pressure diffusion bonds the filler metal and the metal of the first and second metal components.

The present invention will be more fully described by way of example with reference to the accompanying drawings in which:

BRIEF DESCRIPTION OF THE DRAWINGS

FIG. 1 is a longitudinal cross-sectional view through a bladed compressor rotor made according to the method of the present invention.

FIG. 2 is a plan view of a fiber preform used in the method of the present invention.

FIG. 3 is a cross-sectional view through the preform shown in FIG. 2.

DETAILED DESCRIPTION OF THE INVENTION

Figure 4:
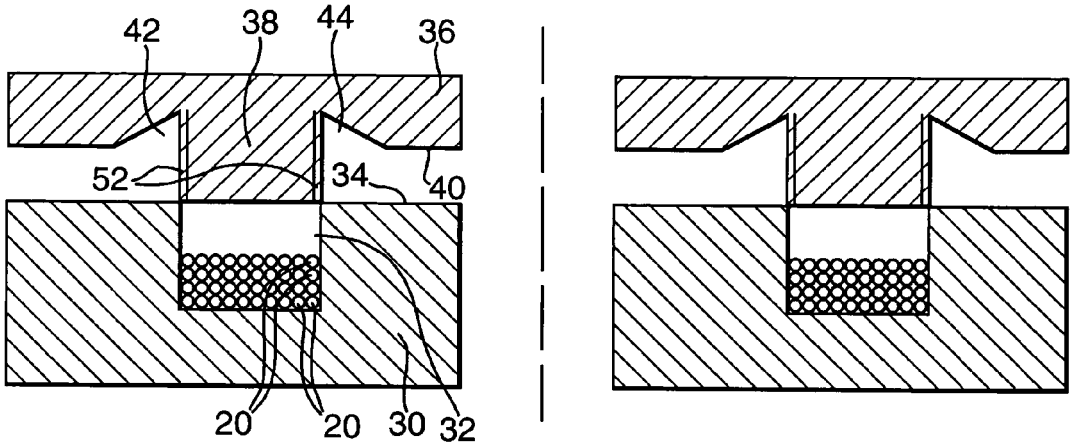
FIG. 4 is a longitudinal cross-sectional view through an assembly of fiber preforms positioned between first and second metal rings.

A finished ceramic fiber reinforced metal rotor 10 with integral rotor blades is shown in FIG. 1. The rotor 10 comprises a metal ring 12, which includes a ring of circumferentially extending reinforcing ceramic fibers 14, which are embedded in the metal ring 12. A plurality of solid metal rotor blades 16 are circumferentially spaced on the metal ring 12 and extend radially outwardly from and are integral with the metal ring 12.

A ceramic fiber reinforced metal rotor 10 is manufactured using a plurality of metal coated ceramic fibers. Each ceramic fiber 14 is coated with metal matrix 18 by any suitable method, for example physical vapour deposition, sputtering etc. Each metal coated 18 ceramic fiber 14 is wound around a mandrel to form an annular, or disc shaped, fiber preform 20 as shown in FIGS. 2 and 3. Each annular, or disc shaped, fiber preform 20 thus comprises a single metal coated ceramic fiber 14 arranged in a spiral with adjacent turns of the spiral abutting each other. A glue 22 is applied to the annular, or disc shaped, fiber preform 20 at suitable positions to hold the turns of the spiral together. The glue is selected such that it may be completely removed from the annular, or disc shaped, fiber preform 20 prior to consolidation. The glue 22 may be for example polymethylmethacrylate in dichloromethane or Perspex in dichioromethane.

A first metal ring, or metal disc, 30 is formed and an annular axially extending groove 32 is machined in one axial face 34 of the first metal ring 30, as shown in FIG. 4. The annular groove 32 has straight parallel sides, which form a rectangular cross-section. A second metal ring, or metal disc, 36 is formed and an annular axially extending projection 38 is machined from the second metal ring, or metal disc, 36 such that it extends from one axial face 40 of the second metal ring, or metal disc 36. The second metal ring, or metal disc, 36 is also machined to form two annular grooves 42 and 44 in the face 40 of the second metal ring, or metal disc 36. The annular grooves 42 and 44 are arranged radially on opposite sides of the annular projection 38 and the annular grooves 42 and 44 are tapered radially from the axial face 40 to the base of the annular projection 38. It is to be noted that the radially inner and outer dimensions, diameters, of the annular projection 38 are substantially the same as the radially inner and outer dimensions, diameters, of the annular groove 32.

One or more of the annular fiber preforms 20 are positioned coaxially in the annular groove 32 in the axial face 34 of the first metal ring 30. The radially inner and outer dimensions, diameters, of the annular fiber preforms 20 are substantially the same as the radially inner and outer dimension, diameters, of the annular groove 32 to allow the annular fiber preforms 20 to be loaded into the annular groove 32 while substantially filling the annular groove 32. A sufficient number of annular fiber preforms 20 are stacked in the annular groove 32 to partially fill the annular groove 32 to a predetermined level.

Figure 5:
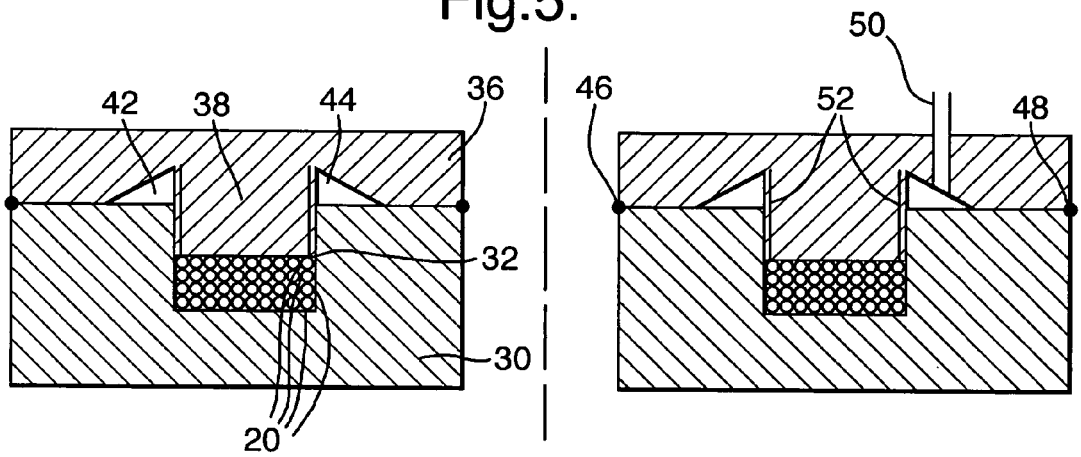
FIG. 5 is a longitudinal cross-sectional view through the assembly of fiber preforms positioned between first and second metal rings after welding together.

The second metal ring 36 is then arranged such that the axial face 40 confronts the axial face 34 of the first metal ring 30 and the axes of the first and second metal rings 30 and 36 are aligned such that the annular projection 38 on the second metal ring 36 aligns with the annular groove 32 in the first metal ring 30. The second metal ring 36 is then pushed towards the first metal ring 30 such that the annular projection 38 enters the annular groove 32 and is further pushed until the axial face 40 of the second metal ring 36 abuts the axial face 34 of the first metal ring 30 as shown in FIG. 5.

The radially inner and outer peripheries of the axial face 34 of the first metal ring 30 are sealed to the radially inner and outer peripheries of the axial face 40 of the second metal ring 36 to form a sealed assembly. The sealing is preferably by TIG welding, electron beam welding, laser welding or other suitable welding processes to form an inner annular weld seal 46 and an outer annular weld seal 48 as shown in FIG. 5.

The sealed assembly is evacuated using a vacuum pump and pipe 50 connected to the grooves, or chambers, 42 and 44. The sealed assembly is then heated, while being continuously evacuated to remove the glue 22 from the annular fiber preforms 20 and to remove the glue 22 from the sealed assembly.

After all the glue 22 has been removed from the annular fiber preforms 20 and the interior of the sealed assembly is evacuated, the pipe 50 is sealed. The sealed assembly is then heated and pressure is applied to the sealed assembly to produce axial consolidation of the annular fiber preforms 20 and diffusion bonding of the first metal ring 30 to the second metal ring 36 and diffusion bonding of the metal on the metal coated 18 ceramic fibers 14 to the metal on other metal coated 18 ceramic fibers 14, to the first metal ring 30 and to the second metal ring 36. During the application of heat and pressure the pressure acts equally from all directions on the sealed assembly, and this causes the annular projection 38 to move axially into the annular groove 32 to consolidate the annular fiber preforms 20.

The application of heat and pressure to the sealed assembly follows a predefined schedule. In particular if the metal of the metal coated 18 ceramic fibers 14 and the metal of the first and second metal rings 30 and 36 comprise substantially the same metal, or alloy, the sealed assembly is heated up to a first temperature and a first pressure is applied to the sealed assembly for a predetermined period of time. Then the sealed assembly is heated up to a second temperature and a second pressure is applied to the sealed assembly for another predetermined period of time. The second temperature is greater than the first temperature and the second pressure is greater than the first pressure.

Figure 7:
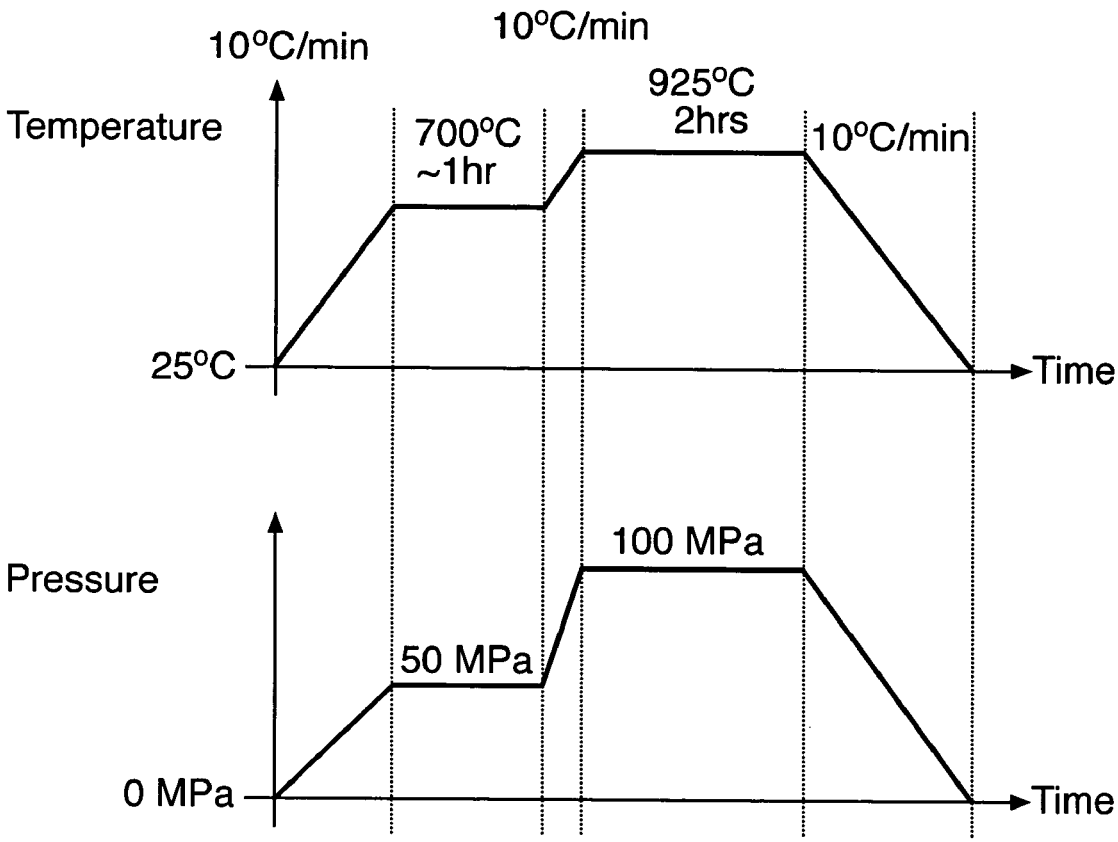
FIG. 7 is a chart showing the temperature and pressure cycles used in a method of the present invention.

For example if the metal on the metal coated 18 ceramic fibers 14 is a titanium alloy comprising 6 wt % aluminium, 4 wt % vanadium and the balance titanium plus incidental impurities and the metal of the first metal ring 30 and the second metal ring 36 is the same alloy, then the first temperature is about 700° C., the first pressure is about 50 Mpa, the second temperature is about 925° C. and the second pressure is about 100 Mpa, as is shown in FIG. 7. The first pressure and temperature is held constant for about one hour and the second pressure and temperature is held constant for about 2 hours. The temperature is increased and/or decreased at a rate of about 10° C. per minute.

If the metal on the metal coated 18 ceramic fibers 14 is a titanium alloy comprising 6 wt % aluminium, 4 wt % vanadium and the balance titanium plus incidental impurities and the metal of the first metal ring 30 and the second metal ring 36 is a titanium alloy comprising 6 wt % aluminium, 4 wt % tin, 4 wt % zirconium, 2 wt % molybdenum, 0.1 wt % Silicon and the balance titanium plus incidental impurities then the first temperature is about 700° C., the first pressure is about 50 Mpa, the second temperature is about 925° C. and the second pressure is about 100 Mpa, as is shown in FIG. 7. The first pressure and temperature is held constant for about one hour and the second pressure and temperature is held constant for about 2 hours. The temperature is increased and/or decreased at a rate of about 10° C. per minute.

If the metal on the metal coated 18 ceramic s fibers 14 is a titanium alloy comprising 6 wt % aluminium, 4 wt % tin, 4 wt % zirconium, 2 wt % molybdenum, 0.1 wt % silicon and the balance titanium plus incidental impurities and the metal of the first metal ring 30 and the second metal ring 36 is the same alloy, then the first temperature is about 700° C., the first pressure is about 50 Mpa, the second temperature is about 925° C. and the second pressure is about 100 Mpa, as is shown in FIG. 7. The first pressure and temperature is held constant for about one hour and the second pressure and temperature is held constant for about 2 hours. The temperature is increased and/or decreased at a rate of about 10° C. per minute.

The heating of the sealed assembly to the first temperature and the application of the first pressure on the sealed assembly causes the metal on the metal coated 18 ceramic fibers 20 to be pre-consolidated because there is only point/line contact between the metal coated 18 ceramic fibers 14 and the first and second metal rings 30 and 36, or between metal coated 18 ceramic fibers 14, with some minor consolidation of the first and second metal rings 30 and 36 at the points/lines where the metal coated 18 ceramic fibers 14 contact the first and second metal rings 30 and 36.

At the first temperature and the first pressure the high metal coated 18 ceramic fiber 14 to metal coated 18 ceramic fiber 14 contact stresses and the high metal coated 18 ceramic fiber 14 to first and second metal rings 30 and 36 contact stresses promote creep flow of the metal matrix material 18 on the ceramic fibers 14 and hence starts densification. The first temperature and the first pressure only subjects the first and second metal rings 30 and 36 to relatively low stresses and the creep flow is significantly less than in the metal matrix 18 on the ceramic fibers 14. Thus the first and second metal rings 30 and 36 retain their shape while the metal matrix material 18 on the ceramic fiber 14 is partially densified, and thus the shape is controlled. The lower temperature of the first temperature is too cool for significant diffusion and full density cannot be achieved using the first temperature alone. The first temperature reduces the likelihood of diffusion bonding, which is detrimental during the consolidation phase.

The heating of the sealed assembly to the second temperature and the application of the second pressure on the sealed assembly causes the metal of the first and second metal rings 30 and 36 and the metal of the metal coated 18 ceramic fibers 14 to be deformed more easily, which completes the consolidation of the metal matrix material 18 on the ceramic fibers 14 and enables diffusion bonding of the first and second metal rings 30 and 36 and the metal coated 18 ceramic fibers 14 together. At the second temperature and the second pressure, the temperature and pressure achieve substantially full density and all the components are diffusion bonded into a single integral article. The second temperature and the second pressure are sufficient to produce errors in shape, but the partial densification during the first temperature and first pressure minimizes these errors in shape.

If the metal, or alloy, on the metal coated 18 ceramic fibers 14 is different to the metal, or alloy, of the first and second metal rings 30 and 36 then the first temperature and first pressure still produces the consolidation of the metal on the metal coated 18 ceramic fibers 14 and the second temperature and second pressure still produces consolidation of the first and second metal rings 30 and 36 and the first temperature and first pressure are smaller than the second temperature and second pressure respectively.

The particular temperatures of the first and second temperatures and the particular pressures of the first and second pressures depend upon the particular metals, or alloys, on the metal coated 18 ceramic fibers 14 and the metals, or alloys, of the first and second metal rings 30 and 36.

Figure 6:
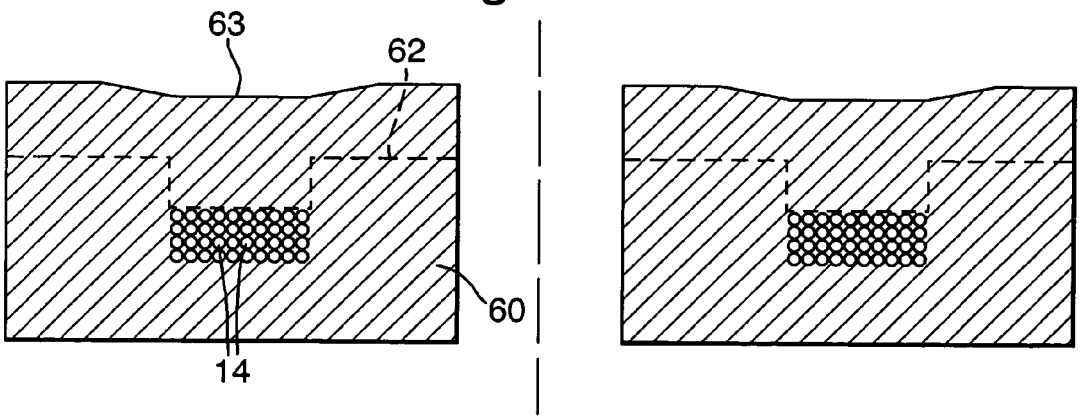
FIG. 6 is a longitudinal cross-sectional view of through the assembly of fiber preforms positioned between first and second metal rings after consolidation and bonding to form a unitary composite article.

The resulting consolidated and diffusion bonded ceramic fiber reinforced component is shown in FIG. 6 which shows the ceramic fibers 14 and the diffusion bond region 62. Additionally the provision of the annular grooves, or chambers, 42 and 44 allows the annular projection 38 to move during the consolidation process and in so doing this results in the formation of a recess 63 in the surface of what was the second metal ring 36. The recess 63 indicates that successful consolidation and diffusion bonding has occurred.

After consolidation and diffusion bonding the article is machined to remove at least a portion of what was originally the first metal ring, at least a portion of the second metal ring and at least a portion of the diffusion bonded region. In the example all of the second metal ring and all of the diffusion bonded region is removed. Thus the fiber reinforced area is retained in it's intended shape with straight, flat, sides and thus the machining is in planes to produce flat, planar, surfaces on the article to provide a uniform distance between the surfaces and the fiber reinforced areas.

The article may then be machined for example by electrochemical machining or milling to form the integral compressor blades 16, as shown in FIG. 1, or the article may be machined to form one or more slots to receive the roots of the compressor blades.

Alternatively, compressor blades may be friction welded, laser welded or electron beam welded onto the article.

The reinforcing fibers may comprise alumina, silicon carbide, silicon nitride, boron or other suitable fiber.

The metal coating on the reinforcing fiber may comprise titanium, titanium aluminide, titanium alloy, aluminium, aluminium alloy, copper, copper alloy or any other suitable metal, alloy or intermetallic which is capable of being diffusion bonded.

The first metal ring and the second metal ring comprise titanium, titanium aluminide, titanium alloy, aluminium, aluminium alloy, copper, copper alloy or any other suitable metal, alloy or intermetallic which is capable of being diffusion bonded.

Figure 8:
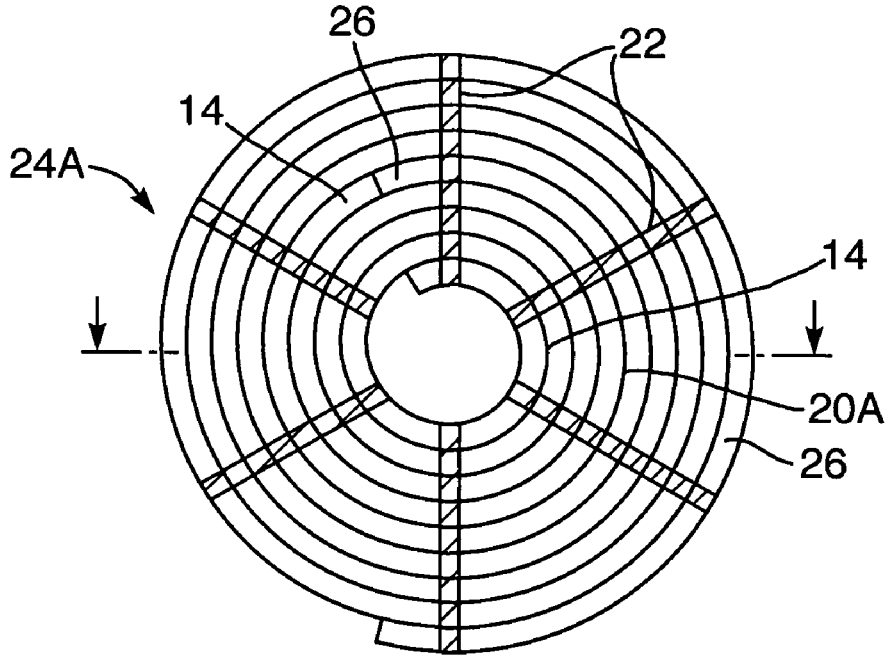
FIG. 8 is a plan view of a fiber and wire preform used in an alternative method of the present invention.
Figure 9:
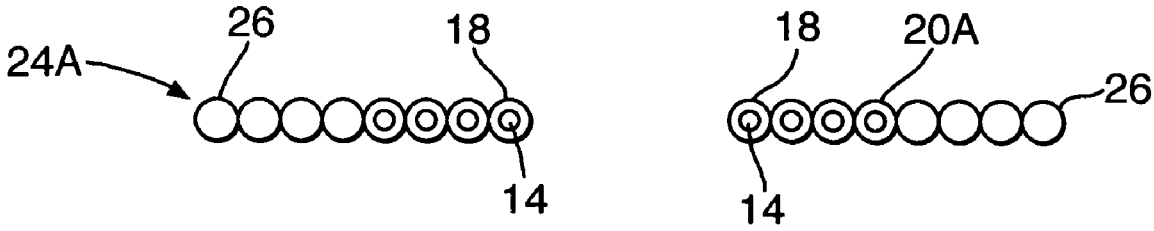
FIG. 9 is a cross-sectional view through the perform shown in FIG. 8.

Although the present invention has been described with reference to spirally wound metal coated fibers alone, the present invention is also applicable to the use of fiber preforms 20A comprising spirally wound metal coated 18 ceramic fibers 14 and preforms 24A comprising spirally wound metal wires 26, as shown in FIGS. 8 and 9. In FIGS. 8 and 9 each fiber preform 20A is arranged in the same plane as an associated preform 24A, but each preform 24A is at a greater diameter. The preforms 20A and 24A may be arranged in different planes. In these cases the metal wires are partially consolidated at the first temperature and first pressure due to point contact in a similar manner to the metal coated ceramic fibers.

Additionally the present invention is applicable to the use of spirally wound ceramic fibers and metal foils, spirally wound ceramic fibers and metal powder, helically wound ceramic fibers in a metal ribbon, spirally wound fibers and spirally wound metal wires or other form of metal filler.

The metal wire may comprise titanium, titanium aluminide, titanium alloy or any other suitable metal, alloy or intermetallic which is capable of being diffusion bonded. The metal foil, metal ribbon, metal powder or other metal filler may comprise titanium, titanium aluminide, titanium alloy or any other suitable metal, alloy or intermetallic which is capable of being diffusion bonded.

Although the present invention has been described with reference to providing a circumferentially extending groove in an axial face of a first metal ring and a circumferentially extending projection on an axial face of a second metal ring it is equally applicable to the provision of a circumferentially extending groove on a radially outer or inner face of a ring.

The present invention is also applicable to any arrangement where the fibers are placed between two or more metal components.

Although the present invention has been described with reference to reinforcement of metal rings it is equally applicable to other arrangements and in such cases the reinforcing metal coated fibers will be arranged accordingly.

Although the present invention has been described with reference to the placing of the filler metal and the ceramic fibers between two metal components and the diffusion bonding of the filler metal and two metal components, the filler metal and ceramic fibers may be placed between two tools but the filler metal is not bonded to the tools.

The advantages of the present invention is that it provides a single consolidation and diffusion bonding process, the two stage process reduces the likelihood of loss of control of the final shape of the fiber reinforced area of the fiber reinforced metal matrix composite article by providing partial densification at a lower temperature and final densification and diffusion bonding at a higher temperature. and full density cannot be achieved using the first temperature alone. The first temperature reduces the Although the present invention has been described with reference to the use of two temperatures and two pressures, it may be possible to use more than two temperatures and more than two pressures.

I claim:

1. A method of manufacturing a fiber reinforced metal matrix composite article, the method comprising the steps of:

(a) placing at least one fiber and filler metal between a first metal component and a second metal component and forming a circumferentially extending groove in an axial face of said first metal component, placing at least one circumferentially extending fiber and said filler metal in said circumferentially extending groove of said first metal component and placing said second metal component in the circumferentially extending groove of said first metal component and forming a projection on said second metal component and placing the projection of said second metal component in the circumferentially extending groove of said first metal component, (b) heating to a first temperature and applying a first pressure for a predetermined period of time in order to partially consolidate the at least one fiber and filler metal and to provide partial densification of the metal on the metal coated fibers and (c) heating to a second temperature and applying a second pressure for a predetermined period of time in order to consolidate the metal of said first and second metal components, and to diffusion bond said filler metal and said first and second metal components, wherein the first temperature is about 700 C the second temperature is about 925 C the first pressure is about 50 Mpa and the second pressure is about 100 Mpa.

2. A method as claimed in claim 1 wherein step (a) comprises placing at least one metal coated fiber, at least one fiber and at least one metal wire or at least one fiber and at least one metal foil between the first metal component and the second metal component, step (b) comprises heating to a first temperature and applying a first pressure to partially consolidate the metal on the at least one metal coated fiber, the at least one metal wire or the at least one metal foil.

3. A method as claimed in claim 2 wherein the at least one metal coated fiber is a titanium coated fiber, a titanium aluminide coated fiber or a titanium alloy coated fiber.

4. A method as claimed in claim 2 wherein the at least one metal wire is one of a titanium wire, a titanium aluminide wire and a titanium alloy wire.

5. A method as claimed in claim 1 wherein the metal of the filler metal is the same metal as the first metal component and is the same metal as the second metal component.

6. A method as claimed in claim 5 wherein the first and second metal components comprise a titanium alloy and the at least one circumferentially extending fiber is coated in a titanium alloy or the at least one metal wire is a titanium alloy wire.

7. A method as claimed in claim 1 wherein the metal of the filler metal is a different metal to the first metal component and to the second metal component.

8. A method as claimed in claim 1 wherein the fibers are silicon carbide fibers, silicon nitride fibers, boron fibers or alumina fibers.

9. A method as claimed in claim 1 wherein the first metal component and the second metal component comprise one of titanium, titanium aluminide and titanium alloy.

10. A method as claimed in claim 1 wherein step (a) comprises placing a plurality of fibers between the first and second metal components.

11. A method as claimed in claim 1 wherein the pressure acts equally from all directions throughout the simultaneous application of heat and pressure.

12. A method of manufacturing a fiber reinforced metal matrix composite article, the method comprising the steps of:

(a) providing at least one fiber and filler metal and placing the at least one fiber and said filler metal between a first metal component and a second metal component and forming a circumferentially extending groove in said first metal component, placing at least one circumferentially extending fiber and said filler metal in the circumferentially extending groove of said first metal component and placing said second metal component in the circumferentially extending groove of said first metal component, (b) heating to a first temperature and applying a first pressure for a predetermined period of time in order to partially consolidate the at least one fiber and filler metal and to provide partial densification of the metal on the metal coated fibers and (c) heating to a second temperature and applying a second pressure for a predetermined period of time in order to further consolidate the metal of the filler, to consolidate the metal of the first and second metal components, and to diffusion bond the filler metal and the first and second metal components wherein the first temperature is about 700 C the second temperature is about 925 C the first pressure is about 50 Mpa and the second pressure is about 100 Mpa.

13. A method as claimed in claim 12 wherein the first and second metal components comprise a titanium alloy and the at least one fiber is coated in a titanium alloy or the filler metal is a titanium alloy.

14. A method of manufacturing a fiber reinforced metal matrix composite article, the method comprising tie steps of:

(a) placing at least one fiber and filer metal between a first metal component and a second metal component and forming a circumferentially extending groove in said first metal component, placing at least one circumferentially extending fiber and said filler metal in said circurnferentiaily extending groove of said first metal component and placing said second metal component in said circumferentially extending groove of said first metal component, (b) heating to a first temperature and applying a first pressure for a predetermined period of time in order to partially consolidate the at least one fiber and filler metal and to provide partial densification of the metal on the metal coated fibers and (c) heating to a second temperature and applying a second pressure for a predetermined period of time in order to consolidate the metal of the first and second metal components, wherein the metal of the filler metal is the same metal as the first metal component and is the same metal as the second metal component wherein the first and second metal components comprise a titanium alloy and the at least one fiber is coated in a titanium alloy or the at least one metal wire is a titanium alloy wire, the first temperature is about 700 C the second temperature is about 925 C. the first pressure is about 50 Mpa and the second pressure is about 100 Mpa wherein the at least one fiber and filler metal comprises a metal coated fiber or a fiber and a metal wire.

15. A method of manufacturing a fiber reinforced metal matrix composite article, the method comprising the steps of:

(a) placing at least one fiber and filler metal between a first metal component and a second metal component and forming a circumferentially extending groove in said first metal component, placing at least one circumferentially extending fiber and filler metal in the circumferentially extending groove of said first metal component and placing said second metal component in the circumferentially extending groove of said first metal component, (b) heating to a first temperature and applying a first pressure for a predetermined period of time in order to partially consolidate the at least one fiber and filler metal and to provide partial densification of the metal on the metal coated fibers and (c) heating to a second temperature and applying a second pressure for a predetermined period of time in order to consolidate the metal of said first and second metal components, wherein the first temperature is less than the second temperature and the first pressure is less than the second pressure and step (c) includes diffusion bonding of the filler metal and the first and second metal components.

* * * * *